US006402582B1

(12) United States Patent
Sherer

(10) Patent No.: US 6,402,582 B1
(45) Date of Patent: Jun. 11, 2002

(54) MECHANICAL BALLOON BURSTING SYSTEMS

(76) Inventor: Ronald B. Sherer, 103 So. Shaffer Dr., New Freedom, PA (US) 17349

( * ) Notice: Subject to any disclaimer, the term of this patent is extended or adjusted under 35 U.S.C. 154(b) by 0 days.

(21) Appl. No.: 09/551,044

(22) Filed: Sep. 18, 2000

Related U.S. Application Data

(63) Continuation-in-part of application No. 09/108,757, filed on Jul. 1, 1998, now abandoned, which is a continuation-in-part of application No. 08/685,308, filed on Jul. 23, 1996, now Pat. No. 5,772,489, which is a continuation-in-part of application No. 08/515,276, filed on Aug. 15, 1995, now Pat. No. 5,538,451.

(51) Int. Cl.[7] ..... A63H 3/06
(52) U.S. Cl. ..... 446/220; 273/458; 273/138.1
(58) Field of Search ..... 446/220; 472/51, 472/53, 56; 273/458, 138.1, 445

(56) References Cited

U.S. PATENT DOCUMENTS

| | | | | | |
|---|---|---|---|---|---|
| 1,394,277 | A | * | 10/1921 | Chester | 273/445 |
| 1,410,371 | A | * | 3/1922 | Chester | 273/445 |
| 3,092,388 | A | * | 6/1963 | Wagenheim | 446/220 |
| 3,608,903 | A | * | 9/1971 | Cooper | 446/220 |
| 3,685,825 | A | * | 8/1972 | Dorazio | 446/220 |
| 3,795,400 | A | * | 3/1974 | Glass et al. | 273/458 |
| 4,169,593 | A | * | 10/1979 | Wood | 273/458 |
| 4,881,733 | A | * | 11/1989 | Rehkemper et al. | 446/220 |
| 5,527,222 | A | * | 6/1996 | Demita | 446/220 |

* cited by examiner

*Primary Examiner*—Jacob K. Ackun, Jr.
*Assistant Examiner*—Urszula M. Cegielnik
(74) *Attorney, Agent, or Firm*—Ronald B. Sherer; Bartlett & Sherer

(57) ABSTRACT

Several systems for bursting amusement balloons are disclosed. The systems include a hinged lever carrying a puncturing element for bursting the balloon.

20 Claims, 2 Drawing Sheets

FIG.3
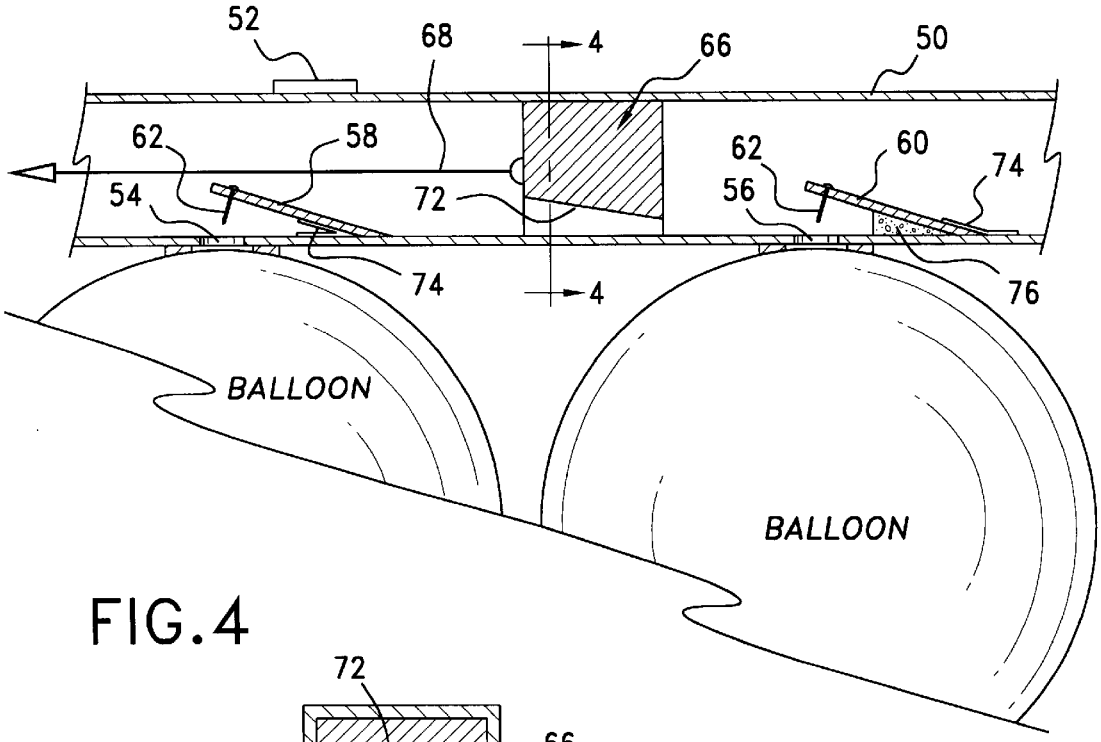
FIG.4
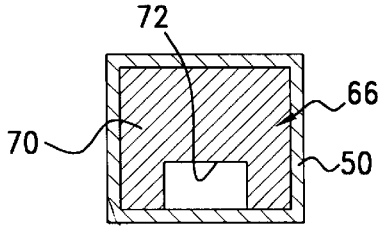
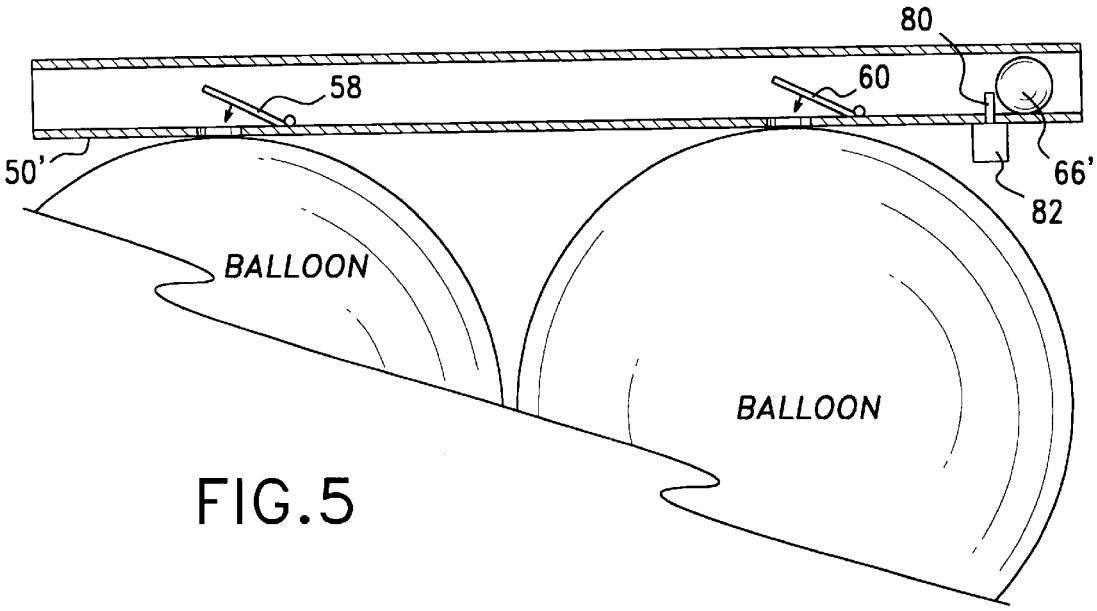
FIG.5

MECHANICAL BALLOON BURSTING SYSTEMS

This Application is a Continuation-In-Part of Application Ser. No. 09/108,757 filed on Jul. 1, 1998 now abandoned which was a Continuation-In-Part of Application Ser. No. 08/685/308, filed on Jul. 23, 1996 now U.S. Pat. No. 5,772,489, which in turn was a Continuation-In-Part of Application Ser. No. 08/515,276, filed on Aug. 15, 1995 now U.S. Pat. No. 5,538,451; which patents are hereby incorporated by reference.

FIELD OF INVENTION

This Application relates to the field of bursting amusement balloons by non-explosive systems, and more particularly, by mechanical systems.

BACKGROUND

The above-identified U.S. Patents disclose the discovery that electrical detonation of amusement balloons does not require an explosive or flammable charge, and that inflated balloons may be caused to explode themselves if a very small gage filament wire is electrically heated in proximity to the balloon. However, this system requires the relatively labor-intensive and relatively costly step of connecting the very small gage filament wires to the lead wires, such as by soldering or crimping, or otherwise making these connections, as well as the cost of batteries or other electrical power. Such electrical systems are excellent for professional use at relatively large events. However, an ultra simple and low cost system is needed for non-professional use such as in the home and other relatively small festive events.

SUMMARY

The present invention eliminates the cost of connecting such small gage filament wires, as well as the entire cost and complexity of electrical systems. In brief, the present invention provides an extremely low cost mechanical puncturing system which can easily be used by non-professionals.

BRIEF DESCRIPTION OF DRAWINGS

FIGS. 3, 4 and 5 are side elevational views illustrating additional embodiments of the invention for bursting a plurality of balloons.

DETAILED DESCRIPTION

Figure 1:
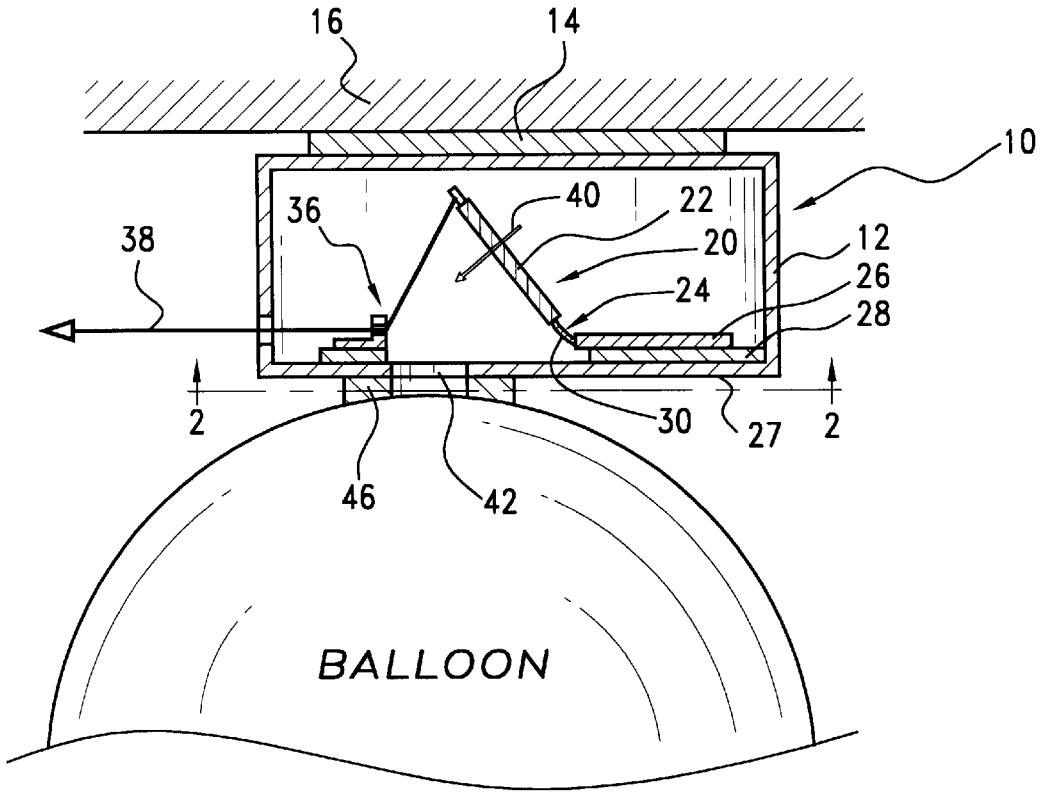
FIG. 1 is a schematic elevational view in cross-section showing one embodiment of the present invention.
Figure 2:
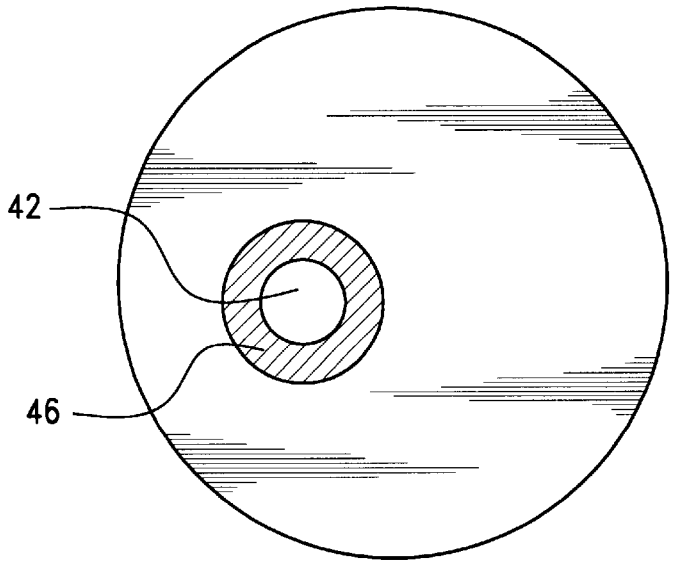
FIG. 2 is a plan view taken along view line 2—2 of FIG. 1.

As shown in FIG. 1, numeral 10 indicates a mechanical balloon bursting system. System 10 includes a housing 12, which may be rectangular, oval or square, but is preferably circular in cross-section as shown in FIG. 2. Housing 12 includes means 14 for attaching the housing to a ceiling structure or archway or other elevated structure 16. Means 14 may comprise double-sided adhesive tape, or other means such as screws, bolts, etc. to mount housing 10 at an elevated position.

Housing 12 may be composed of plastic, cardboard or other low-cost material and it contains a mechanical puncturing system 20. This puncturing system includes a pivoted lever 22 which is pivoted at point 24 to a fixed portion 26.

Portion 26 may be glued to the bottom 27 of the housing, or may be connected by double-sided adhesive tape 28, or by other connection means.

Many forms of pivotal connections between portions 22 and 26 of the hinge will be apparent to those skilled in the art. However, it has been discovered that lever 22 and fixed portion 26 may be formed of one, single and integral piece such as by plastic molding. In this preferred embodiment, lever 22 and fixed portion 26 are connected to each other by a thinner, flexible hinge portion 30. In this embodiment, the integral piece is molded in a configuration such that lever 22 is in the elevated position shown in FIG. 1 so long as no force is applied to it.

Housing 12 preferably includes a trigger line guide 36 through which a trigger line 38 extends outwardly of the housing. Lever 22 carries a puncturing pin 40 such that, when trigger line 38 is pulled to the left as viewed in FIG. 1, the trigger line pulls lever 22 downwardly causing pin 40 to pass through aperture 42 in the bottom of housing 12.

As further shown in FIG. 2, aperture 42 is surrounded by an annular adhesive layer 46, or two strips of adhesive may be positioned on opposite sides of the aperture. In either event, a balloon may be readily secured to the detonator by simply pushing the balloon against the bottom surface of adhesive layer 46 such that the balloon adheres to layer 46. Thus, when trigger line 38 is pulled, lever 22 forces pin 40 through hole 42 which causes the balloon to burst.

From the foregoing description of the embodiment of FIGS. 1 and 2, it will be apparent that any non-professional person may mount the housing to the ceiling or other elevated place, and stick one balloon to the detonator. Then such person may pull the trigger line whenever the balloon is to be burst. However, the present invention also enables more than one balloon to be exploded as illustrated in FIGS. 3–5.

Referring to FIGS. 3 and 4, a tube 50 is secured to an elevated place by double-stick tape 52, or by other mechanical means as previously recited. Tube 50 contains a plurality of apertures such as 54 and 56, and a plurality of hinged levers such as 58 and 60. Each of the levers carries a puncturing pin 62 which passes through the corresponding aperture when the levers are moved downwardly.

In the FIG. 3–4 embodiment, the means for moving levers downwardly comprise a cam 66 which is pulled to the left as viewed in FIG. 3 by a trigger line 68. As further illustrated in FIGS. 3 and 4, cam 66 may comprise a body 70 of square or rectangular cross-section having a cam surface 72 which engages the upper surfaces of the levers as the cam is pulled over the levers by line 68. Thus, as the cam is pulled by line 68, each of a plurality of levers is depressed and the associated balloons are burst in sequence.

The means for maintaining the levers in the elevated positions may comprise the molded plastic hinge as previously described. Alternatively, they may comprise a V-shaped, or wedge-shaped, plastic hinge 74 which is molded in the shape shown in FIG. 3 as associated with lever 58. Thus, lever 58 remains in the retracted, elevated and safe position as illustrated unless and until the lever is forced downwardly by the cam, and immediately thereafter, the lever springs back to its safe and retracted position.

An alternative means for biasing the lever upwardly into the retracted position is shown in FIG. 3 with respect to lever 60 which is secured by a hinge so as to pivot about the lower end, and such hinge may be as simple as a piece of flexible adhesive tape 74. In order to bias the lever upwardly, a spring or piece of resilient material 76 may be positioned between the bottom of tube 50 and the underneath side of lever 60. Therefore, in either of the embodiments shown in FIG. 3, the levers are hinged and biased into the retracted and safe position as shown in the drawings, and they return to this safe position immediately after bursting the balloon.

It will also be understood that the cross-section of the cam and tube may be circular. In this event, it is preferred that the tube include an elongated guide, such as a fin or other projection, which is received in a groove in the cam for the purpose of preventing any possibility of the cam rotating about the axis of longitudinal movement.

Referring to FIG. 5, tube 50' contains the same levers 58, 60 and apertures 54, 56 as previously described. However, instead of a cam pulled by a trigger line, the FIG. 5 embodiment utilizes a cam in the form of a ball 66'. Ball 66' rolls down tube 50' which is slightly inclined as illustrated. Ball 66' may be a marble or metallic ball so long as it has sufficient weight to depress the levers and thereby burst the plurality of balloons as the ball rolls to the left as viewed in FIG. 5.

In order to control the ball and cause it to roll down the tube only when desired, gate means 80 and actuator means 82 are provided. In the totally non-electrical embodiment, gate means 80 may be a rod, or other projection which is biased upwardly by a spring or other resilient means into the blocking position as illustrated. In this embodiment, actuator means 82 may be a simple trigger line which, when pulled downwardly, retracts the gate and allows the ball to roll along tube 50' and sequentially depress the levers into their balloon bursting positions. Alternatively, actuator means 82 may be an electrical solenoid which retracts gate 80 when it is desired to burst the balloons; such solenoid being connected to a power source and a switch not illustrated.

From the foregoing description of several preferred embodiments, many variations will become apparent to those skilled in the art of exploding amusement balloons. Therefore, it is to be understood that the foregoing description is intended to be purely illustrative of the principles of the invention, and that the true invention is not intended to be limited other than as set forth in the following claims construed under the Doctrine of Equivalents.

What is claimed is:

1. A detonator system for bursting an amusement balloon at an elevated location comprising:

(a) a housing, said housing having upper and lower end walls and at least one side wall;

(b) first attachment means for attaching said upper end wall to an elevated horizontally extending surface;

(c) second attachment means for attaching an inflated amusement balloon to said lower end wall;

(d) lever means in said housing for moving from a first position retracted in said housing to a second puncturing position;

(e) puncturing means carried by said lever means for puncturing the balloon attached to said lower end wall when said lever means is moved into said second puncturing position; and (f) trigger means connected to said lever means for moving said lever means from said first retracted position to said second puncturing position and bursting the balloon.

2. The detonator system of claim 1 wherein said trigger means comprise a trigger line having one end connected to said lever means, and guide means in said housing for directing said trigger line in a substantially downward direction as said lever means is moved into said puncturing position by said trigger line.

3. The detonator system of claim 1 including resilient means for maintaining said lever means in said first retracted position so long as said trigger means does not move said lever means into said second puncturing position.

4. The detonator system of claim 3 wherein said lever means and said resilient means comprise a molded plastic hinge means having a resilient portion for urging said lever means into said first retracted position.

5. The detonator of claim 1 wherein said first attachment means comprise an adhesive.

6. The detonator of claim 1 wherein said second attachment means comprise an adhesive.

7. The detonator of claim 5 wherein said adhesive comprises adhesive tape with a peel-off layer on at least one side.

8. The detonator of claim 6 wherein said adhesive comprises adhesive tape with a peel-off layer on at least one side.

9. An assembly for bursting an amusement balloon at an elevated position comprising:

(a) a pivotal hinge;

(b) said hinge having a movable portion and a stationary portion;

(c) said hinge having a flexible pivoting portion connecting said movable portion to said stationary portion;

(d) puncturing means carried by said movable hinge portion for moving from a retracted position to a balloon puncturing position;

(e) resilient means for urging said movable hinge portion into said retracted position;

(f) first support means for supporting said stationary hinge portion at an elevated position;

(g) second support means for supporting an inflated balloon in a balloon puncturing position; and (h) actuator means connected to said movable hinge portion for moving said movable hinge portion and said puncturing means from said retracted position to said balloon puncturing position against the urging of said resilient means.

10. The balloon bursting assembly of claim 9 wherein said movable, stationary and flexible portions of said hinge comprise a single one-piece hinge.

11. The balloon bursting assembly of claim 10 wherein said single one-piece hinge is an integral molded plastic piece, and said piece is molded with said movable portion in said retracted position, and said flexible portion comprises said resilient means and is molded such as to maintain said movable portion in said retracted position so long as said actuator means does not move said movable portion into said balloon puncturing position.

12. The balloon bursting assembly of claim 10 wherein said actuator means comprise a trigger line, said trigger line having one end connected to said movable hinge portion, and guide means adjacent said pivotal hinge for guiding the direction of said trigger line as said trigger line moves said movable hinge portion into said balloon puncturing position to burst the balloon.

13. An amusement device for bursting inflated amusement balloons comprising:

(a) a housing;

(b) said housing having an upper horizontally extending wall, a lower horizontally extending wall and at least one vertically extending side wall extending between said upper and lower walls;

(c) said lower horizontal wall having a hole;

(d) attachment means adjacent said hole for attaching an inflated amusement balloon;

(e) means for attaching said upper horizontal wall to an elevated horizontally extending surface;

(f) movable means in said housing for moving from a retracted position to a balloon puncturing position;

(g) balloon puncturing means carried by said movable means for moving through said hole to puncture the inflated balloon in said puncturing position;

(h) means for maintaining said movable means in said retracted position with said balloon puncturing element entirely retracted in said housing; and (i) trigger means for moving said movable means and said puncturing means from said retracted position in said housing to said puncturing position with said puncturing means extending through said hole to burst the balloon.

14. The amusement device of claim 13 in which said movable means comprise a pivoted lever.

15. The amusement device of claim 14 in which said means for maintaining said movable means in said retracted position comprise resilient means for urging said pivoted lever and puncturing means in said retracted position.

16. The amusement device of claim 15 in which said movable means and said means for maintaining comprise an integral one-piece integral hinge.

17. The amusement device of claim 16 in which said integral one-piece hinge is comprised of a single molded plastic piece, said molded plastic piece including a resilient portion comprising said resilient means for urging said pivoted lever in said retracted position.

18. A system for sequentially exploding a plurality of balloons comprising:

(a) an elongated hollow element;

(b) a plurality of balloon puncturing means for bursting balloons spaced along the length of said elongated hollow element; and (c) actuator means for sequentially moving said balloon puncturing means into balloon puncturing positions as said actuator means move along the length of said elongated hollow element.

19. The system of claim 18 wherein said actuator means comprise means having a circular cross-section for passing along said elongated hollow element and actuating said balloon puncturing means.

20. The system of claim 18 wherein said actuator means have a non-circular cross-section and said elongated hollow element has a non-circular cross-section.

* * * * *